US007726447B2

(12) United States Patent
Kawaguchi et al.

(10) Patent No.: US 7,726,447 B2
(45) Date of Patent: Jun. 1, 2010

(54) INSPECTION SCAFFOLD OF LARGE COMPONENT FOR BOILER AND BUILDING METHOD THEREOF

(75) Inventors: Shigeyoshi Kawaguchi, Chiyoda-ku (JP); Kazuhito Nakamitsu, Chiyoda-ku (JP); Sinnichi Sagawa, Chiyoda-ku (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 1151 days.

(21) Appl. No.: 11/293,113

(22) Filed: Dec. 5, 2005

(65) Prior Publication Data

US 2007/0074934 A1 Apr. 5, 2007

(30) Foreign Application Priority Data

Sep. 20, 2005 (JP) ..... 2005-272371

(51) Int. Cl.
*E04G 3/00* (2006.01)

(52) U.S. Cl. ..... 182/142; 182/141; 182/150; 122/510

(58) Field of Classification Search ..... 182/128, 182/150, 141, 142; 122/450, 493, 510; 29/890.03, 29/890.051
See application file for complete search history.

(56) References Cited

U.S. PATENT DOCUMENTS 1,725,183 A * 8/1929 Fischer ..... 182/142
3,168,163 A * 2/1965 Prosser ..... 182/142
3,420,332 A * 1/1969 Textor ..... 182/128
3,853,204 A * 12/1974 Smith ..... 182/128
3,866,382 A * 2/1975 Van Tassel ..... 52/749.15
3,900,080 A * 8/1975 Rea ..... 182/36
4,058,184 A * 11/1977 Stuart et al. ..... 182/128
4,068,738 A * 1/1978 Reed ..... 182/128
4,234,055 A * 11/1980 Beeche ..... 182/142
4,253,548 A * 3/1981 Beeche ..... 182/142
4,253,549 A * 3/1981 Petren ..... 182/150
4,276,956 A * 7/1981 Mamula et al. ..... 182/128
4,388,982 A * 6/1983 Yonahara ..... 182/82
4,474,143 A * 10/1984 Wincze ..... 122/379
4,474,497 A * 10/1984 Sullivan ..... 432/76

(Continued)

FOREIGN PATENT DOCUMENTS

JP A 59-044504 3/1984

(Continued)

*Primary Examiner*—Katherine W Mitchell
*Assistant Examiner*—Colleen M Quinn
(74) *Attorney, Agent, or Firm*—Oliff & Berridge, PLC

(57) ABSTRACT

A scaffold assembling of a large component for a boiler requiring inspection is not performed by a high-place work but assembled safely and in a short time. The scaffold is assembled to the large component for the boiler supported by a component supporting beam at the ground side before it is attached to a steel frame main-beam 16. Scaffold lifting/supporting beams interposing coil spaces of a superheater 14 are suspended on wires 36 lifted down from spaces of a ceiling tube wall 34 being a horizontal member of the superheater 14. The scaffold lifting/supporting beams 32 are lifted to raise little by lithe within the superheater, and scaffold components are assembled sequentially toward downward. After a required number of steps of scaffolds are assembled, the scaffold lifting/supporting beams 32 are coupled to the ceiling tube wall 34 to be supported. Finally, the superheater 14 is raised by a lifting means to install to the main-beam.

4 Claims, 11 Drawing Sheets

U.S. PATENT DOCUMENTS

| | | | | | |
|---|---|---|---|---|---|
| 4,815,563 | A | * | 3/1989 | Puccinelli et al. | 182/150 |
| 4,967,875 | A | * | 11/1990 | Beeche | 182/36 |
| 4,971,169 | A | * | 11/1990 | Fruth | 182/119 |
| 5,007,501 | A | * | 4/1991 | Baston | 182/128 |
| 5,301,770 | A | * | 4/1994 | Regan et al. | 182/128 |
| 5,343,978 | A | * | 9/1994 | VanAmburg | 182/128 |
| 5,579,866 | A | * | 12/1996 | Rowell | 182/150 |
| 6,264,001 | B1 | * | 7/2001 | Herschbach | 182/150 |
| 6,286,691 | B1 | * | 9/2001 | Oberhaus et al. | 211/118 |

FOREIGN PATENT DOCUMENTS

| | | |
|---|---|---|
| JP | A-62-022904 | 1/1987 |
| JP | A-09-032121 | 2/1997 |
| JP | A-2001-173901 | 6/2001 |
| JP | A-2004-250944 | 9/2004 |

* cited by examiner

DETAIL OF " A " PORTION

DETAIL OF " B " PORTION

INSPECTION SCAFFOLD OF LARGE COMPONENT FOR BOILER AND BUILDING METHOD THEREOF

BACKGROUND OF THE INVENTION

1. Field Of The Invention

The present invention relates to an inspection scaffold of large components for a boiler and a building method thereof, and particularly relates to the inspection scaffold and the building method thereof to perform pressure tests and the other inspection works of boiler superheater coils placed at a thermal power station.

2. Description of Related Art

Generally, a steam generating equipment of a thermal power station includes a burner, a furnace, a pendant coil group such as a superheater and a reheater, and these are stored inside of a large building. In such a facility, the pendant coils such as the superheater and the reheater are positioned at an upper portion of a boiler, and they are suspended and supported by a main-beam positioned particularly at a top end surface of a steel frame structure constituting a power station building. An assembling construction method is adopted for equipments including particularly a coil to be a steam passage positioned at the upper portion of the boiler such as the superheater, in which they are assembled at a factory and so on by each equipment, carried in the steel frame, lifted by each equipment by using a lifting equipment to suspend and fix to the main-beam, disposed and equipped at a predetermined position, and thereafter assembly items are assembled with each other. After the assembling of power generating equipments is completed finally, a hydraulic test is performed by passing water. Herewith, it is necessary to perform defect inspections and repair works of welded portions of the coil, and therefore, the inspection works at every portion of the coil are required. Consequently, the inspection scaffold of a large component such as the superheater is assembled, and it is a temporary scaffold which is removed after predetermined tests and inspections are finished.

The above-stated conventional inspection scaffold is used for the test after the facility is settled, and therefore, it is attached after the power station equipments are assembled. Consequently, the scaffold is assembled and attached around the coil by a high-place work at dozens of meters upward because the large components such as the superheater including these coils are positioned at a high place at the upper portion of the boiler.

As such kind of scaffold, for example, a scaffold described in Patent Document 1 is used. A suspended scaffold described in this Patent Document 1 is suspended from a boiler main body structure, having a horizontal rigid member to be the scaffold at a top layer, the scaffold of a second layer is composed of two pairs or more of perpendicular rods coupled attachably/detachably to the corresponding horizontal rigid member, horizontal rods provided with flanges at both ends and bridged attachably/detachably between the above-stated paired perpendicular rods,. and a scaffold board bridged between the corresponding horizontal rods, the scaffold of a third layer or later is composed of the perpendicular rods, the horizontal rods and the scaffold boards as same as the second layer, and it is the suspended scaffold within a boiler furnace in which the perpendicular rods are attachably/detachably suspended to the horizontal rods of an upper layer. The above-stated scaffold is provided on a wall surface around a peripheral surface inside of the boiler furnace, and it is assembled around the coil at a high place by the same method.

However, conventionally, as stated above, the building of the scaffold is a high-place work and the scaffold is built after the power station facility is assembled. Consequently, components other than the coil being an inspection object are existing around the coil, and therefore, there is a problem that the assembling work of the scaffold is very difficult. In particular, in the superheater, a lot of narrow coils are coupled to headers, this is vertically disposed in a structure well-ordered in a plane state, and equipped in a lot of lines with narrow intervals, and therefore, there are also problems that the work for the scaffold assembling is difficult and the time required for the assembling is extremely long.

[Patent Document 1] Japanese Patent Application Laid-open No. Sho 59-044504

SUMMARY OF THE INVENTION

The present invention has an eye on the above-stated conventional problems, and an object thereof is to provide an inspection scaffold and a building method capable of assembling the scaffold safely without performing the scaffold assembling of a large component for a boiler requiring inspections in a high-place work. Secondly, the object thereof is to provide a building method capable of drastically shortening hours of work for the assembling of the scaffold. Thirdly, the object thereof is to provide an inspection scaffold and a building method capable of assembling a power station while the scaffold in itself has a protective function of attendant structures of the large component.

To attain the above-stated objects, a building method of an inspection scaffold of a large component for a boiler, including: suspending a scaffold lifting/supporting beam interposing in a space of the large component on a wire lifted down from a space of a horizontal member of the large component, to the large component for the boiler supported by a component supporting beam at the ground side before it is attached to a steel frame main-beam; assembling scaffold components sequentially toward downward while the scaffold lifting/supporting beam is lifted to raise little by little inside of the large component; coupling the scaffold lifting/supporting beam to the horizontal member of the large component to be supported, after a required number of steps of scaffolds are assembled; and building the inspection scaffold together with the large component by raising the large component by a lifting means to couple to the main-beam.

In the above-stated method, the scaffold is constituted by raising each scaffold unit composed of the scaffold lifting/supporting beams, rods coupled to a lower surface side thereof, and scaffold boards, coupling to the horizontal member of the large component, and thereafter, coupling the scaffold units with each other to be integrated.

Besides, the large component is a pendant coil, and plural lines of coil groups, formed by arranging narrow tubes in similar shapes on respective headers in one plane state, are regarded as one block, and the scaffold unit is assembled by each block.

Further, the large component is a superheater, and the horizontal member is a ceiling tube wall.

An inspection scaffold of a large component for a boiler, including: scaffold lifting/supporting beams interposed in spaces of the large component; horizontal and perpendicular rods at least forming scaffold frames at a lower surface portion of the scaffold lifting/supporting beams and capable of being coupled with each other; and scaffold boards bridged between the horizontal rods at the spaces, and wherein required number of steps of the scaffold boards can be sequentially assembled at a lower surface of the scaffold lifting/supporting beam, and wherein the scaffold lifting/supporting beam has a coupling means with a horizontal member of the large component and capable of being suspended and supported by the large component.

Besides, more concretely speaking, it is an inspection scaffold of a large component for a boiler, which is assembled to a pendant coil constituted by arranging plural coil groups perpendicularly in which plural narrow tubes are arranged along a plane surface, including: scaffold lifting/supporting beams capable of raising/lowering at spaces of the coil groups, and capable of coupled and supported by a part of a ceiling tube wall of the pendant coil; perpendicular rods and horizontal rods supported at a lower surface of the lifting/supporting beam and capable of being coupled with each other; and scaffold boards capable of bridged between the horizontal rods, and wherein the inspection scaffold is capable of integrally assembled to the pendant coil while suspended and supported by the ceiling tube wall of the pendant coil.

As having such a constitution, in the present invention, the scaffold is assembled to the large component before installed to the boiler at the power station by each scaffold unit, the scaffold units are coupled with each other and integrated with the large component, and thereafter, the large component is lifted to the steel frame main-beam, and fix to the main-beam. Herewith, an assembling work of attendant equipments to the large component and the scaffold assembling can be simultaneously performed at the ground, and therefore, hours of work for the scaffold assembling can be eliminated drastically, and at the same time, an effect of an enhanced safety in the work can be obtained because it is not a high-place work. The respective scaffold units are disposed at spaces of the large component, and therefore, it has a block structure as a whole, and a merit of preventing a risk of a crash caused by a rolling of each suspended structure of the large component can be obtained. In particular, it is applied to the pendant coil, in which perpendicular coil lines are in a suspended state, and even if a bending force or the like acts, but they are blocked, and therefore, a protective function can be exerted owing to a frame structure of the scaffold composing member.

DETAILED DESCRIPTION OF THE PREFERRED EMBODIMENTS

Hereinafter, an optimal embodiment of an inspection scaffold of a large component for a boiler and a building method thereof according to the present invention is described with reference to the drawings.

Figure 11:
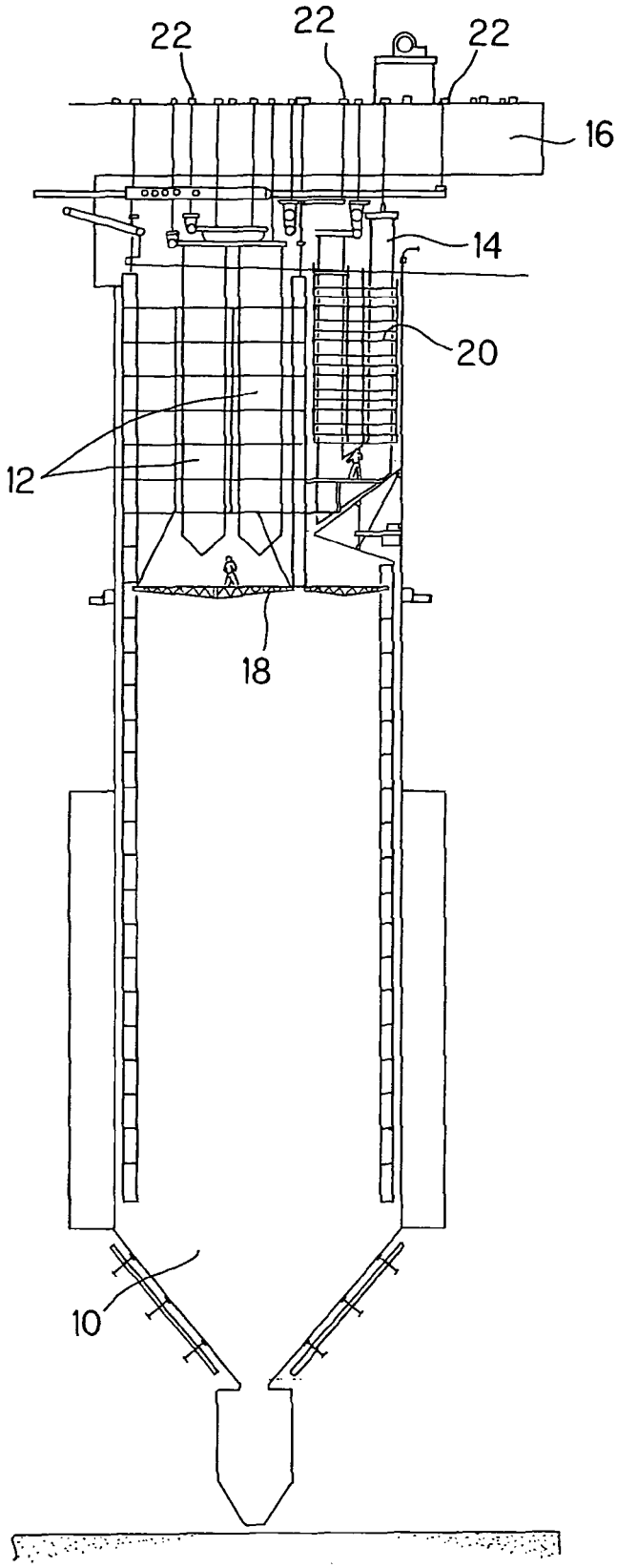
FIG. 11 is an internal sectional view of a boiler furnace in a state the superheater to which the scaffold is assembled is installed to a main-beam.

At first, in FIG. 11, an internal sectional view of a boiler furnace 10 is shown. A second superheater 12 and a third superheater 14 are provided side by side at an upper position of the boiler furnace 10 having dozens of meters height. These are pendant coils suspended and supported by a steel frame main-beam 16. After an assembling to the boiler is completed, pressure tests are performed by passing water into coils for these pendant coils 12, 14 as large components for the boiler, and inspections for presence/absence and so on of a coil welding failure are performed. For this inspection work, an intermediate stage 18 and an inspection scaffold 20 are temporary provided at a lower portion or a peripheral portion of the pendant coils. If the inspection scaffold 20 is built after the pendant coil is assembled to the boiler furnace 10, it becomes a high-place work, and therefore in the present invention, it is assembled to the pendant coil at the time of a ground work.

In a power station having large suspending type boilers, a main-beam 16 for supporting the boilers is provided at a top end portion of a steel frame to be a suspending fabric, and boiler components are supported in a state suspended by this main-beam 16. Plural lifting jacks are placed on the main-beam 16, a block of the boiler components carried in the steel frame is lifted up to the main-beam 16 by using the lifting jacks, and it is supported and suspended by the main-beam 16 by using a sling rod and so on. These works are sequentially repeated from assembling components of an upper portion of the boiler to thereby build up the boiler. Attendant equipments are assembled to the boiler components block at the ground work or in the middle of a lifting operation, and this assembling work of the attendant equipments is often performed in a state supported by a component supporting beam provided at the ground side. In the present invention, the inspection scaffold 20 of the large component is simultaneously assembled together with the assembling of the attendant equipments in a state the large component of the boiler components is suspended to the component supporting beam at the ground.

Figure 1:
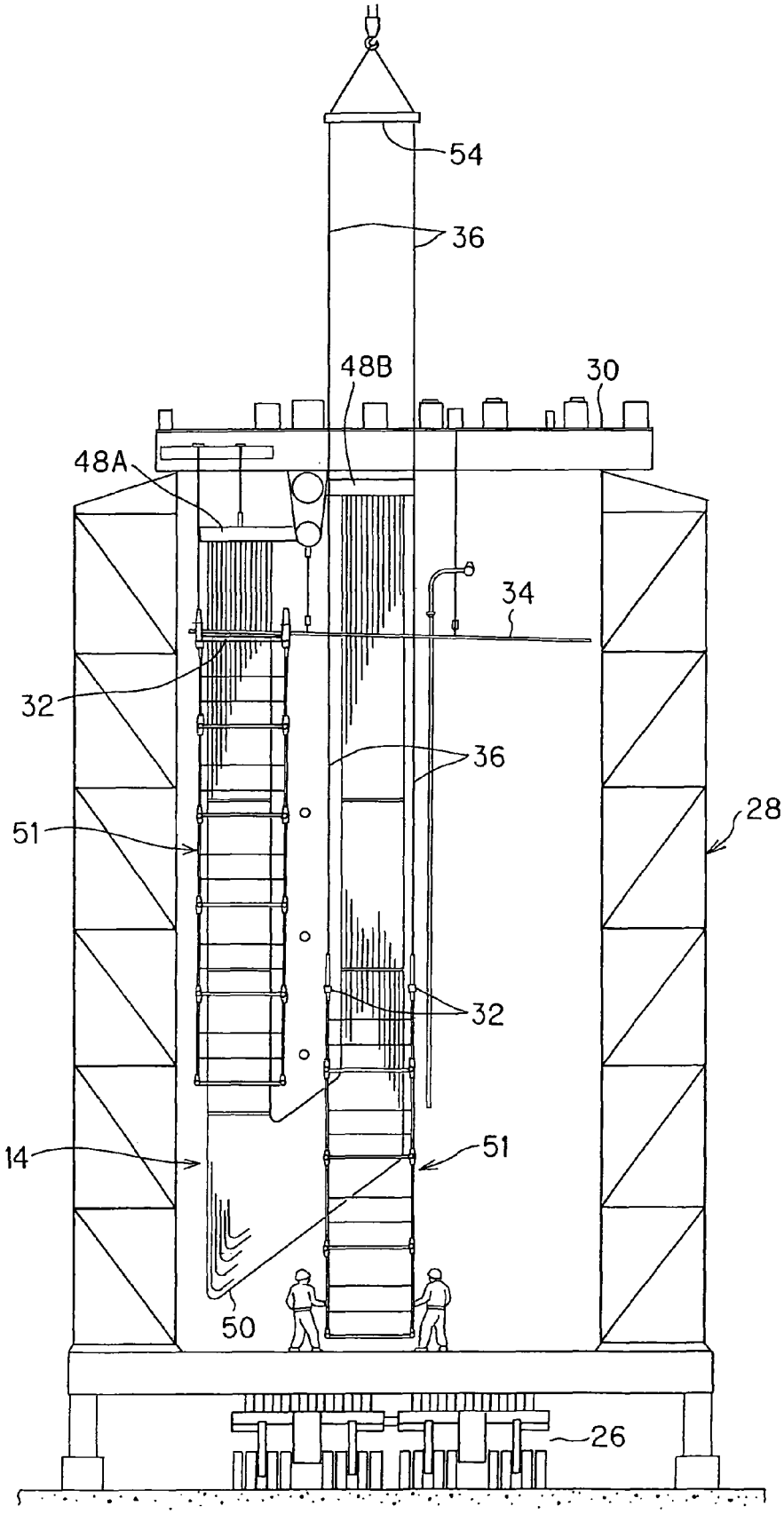
FIG. 1 is a front view showing a working rope for assembling an inspection scaffold to a third superheater on the ground.
Figure 2:
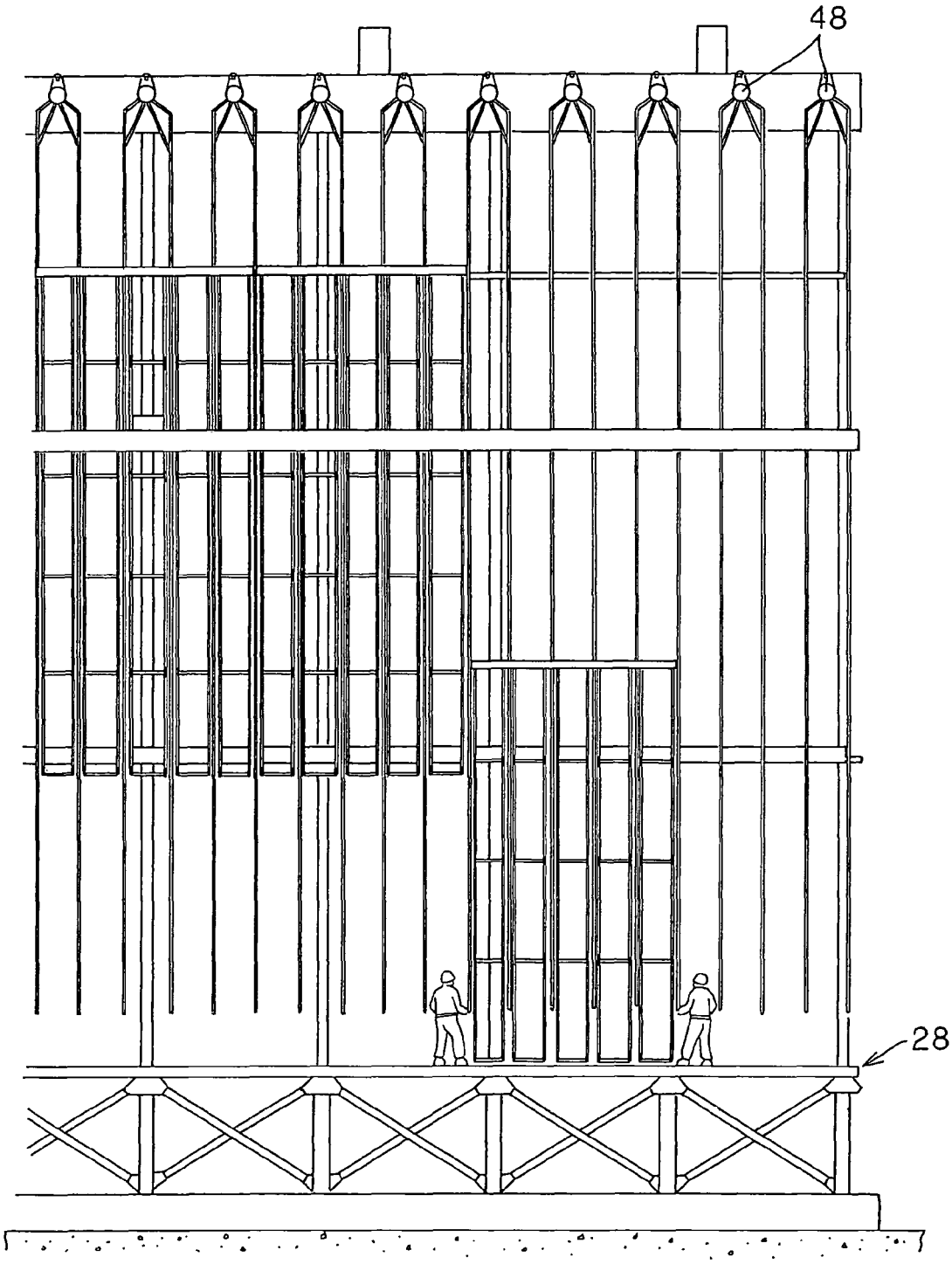
FIG. 2 is a side view of the same.

FIG. 1 and FIG. 2 are showing an embodiment applying the present invention for the third superheater 14 being the large component for the boiler, and they are a front view and a side view showing a working rope for assembling the inspection scaffold 20 to the third superheater 14 at the ground. The superheater 14 is carried into a steel frame of the power station by a carry-in cart 26 in a state suspended and supported by a component supporting beam 30 provided at a top end portion of a movable jack stand 28. A state in the drawing is that the carry-in cart 26 is stopped under a position where the superheater 14 is installed to the main-beam 16.

The assembling work of the inspection scaffold 20 according to the present embodiment is performed to the third superheater 14 as the large component for the boiler supported by the component supporting beam 30 at the ground side under the steel frame main-beam 16, as follows. At first, scaffold lifting/supporting beams 32 interposing in spaces between coil lines of the corresponding third superheater 14 are coupled to wires 36 lifted down from spaces of a ceiling tube wall 34 being a horizontal member of the third superheater 14 to suspend down close to a floor surface. This scaffold lifting/supporting beams 32 are lifted to raise little by little in the spaces of the coil group within the third superheater 14, and the scaffold components are assembled sequentially toward downward. After a required number of steps of the scaffolds are assembled, the scaffold lifting/supporting beams 32 are coupled to be supported to the ceiling tube wall 34 of the large component for the boiler, the third superheater 14 is raised by the lifting jacks to couple to the main-beam 16, to thereby build the inspection scaffold together with the large component.

Figure 3:
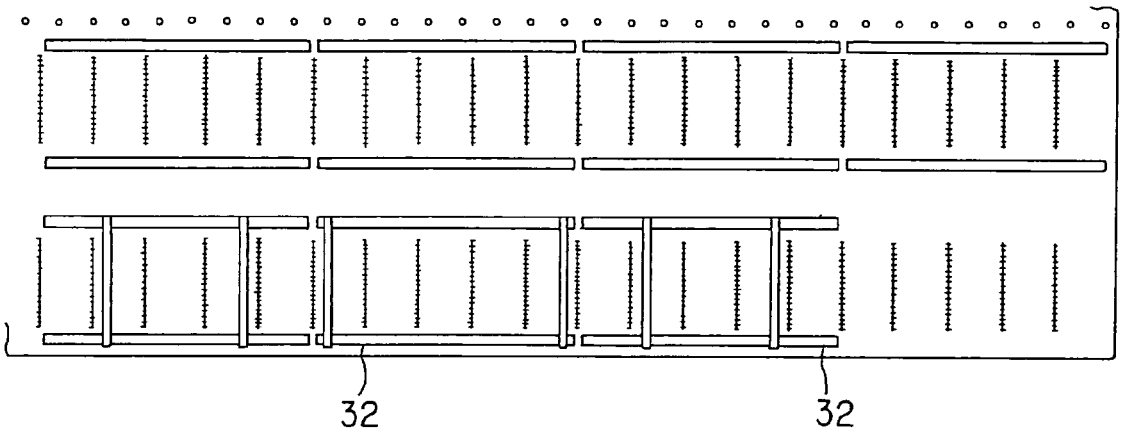
FIG. 3 is a plan view of the same.
Figure 4:
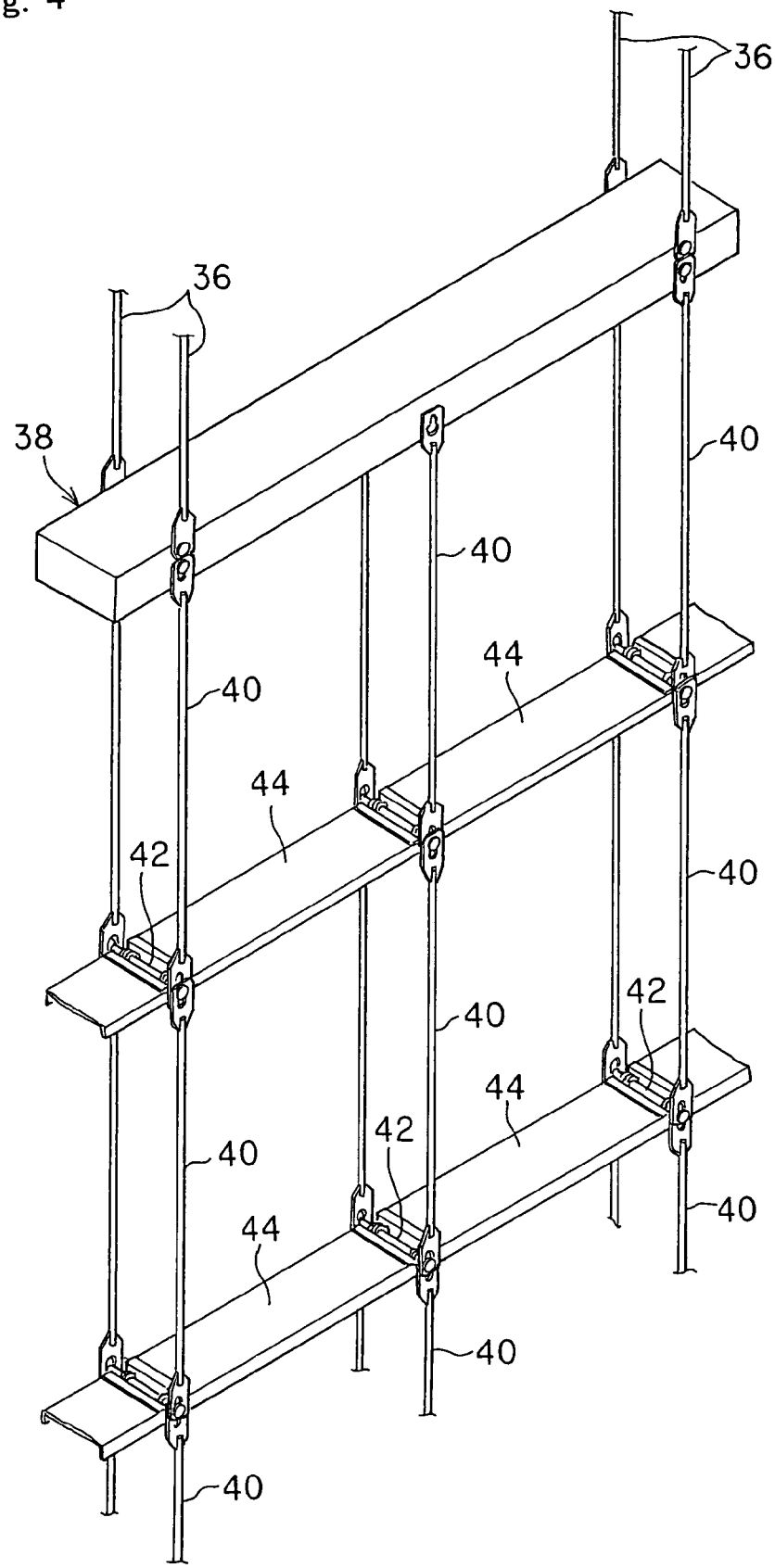
FIG. 4 is an explanatory view of a basic scaffold structure.
Figure 5:
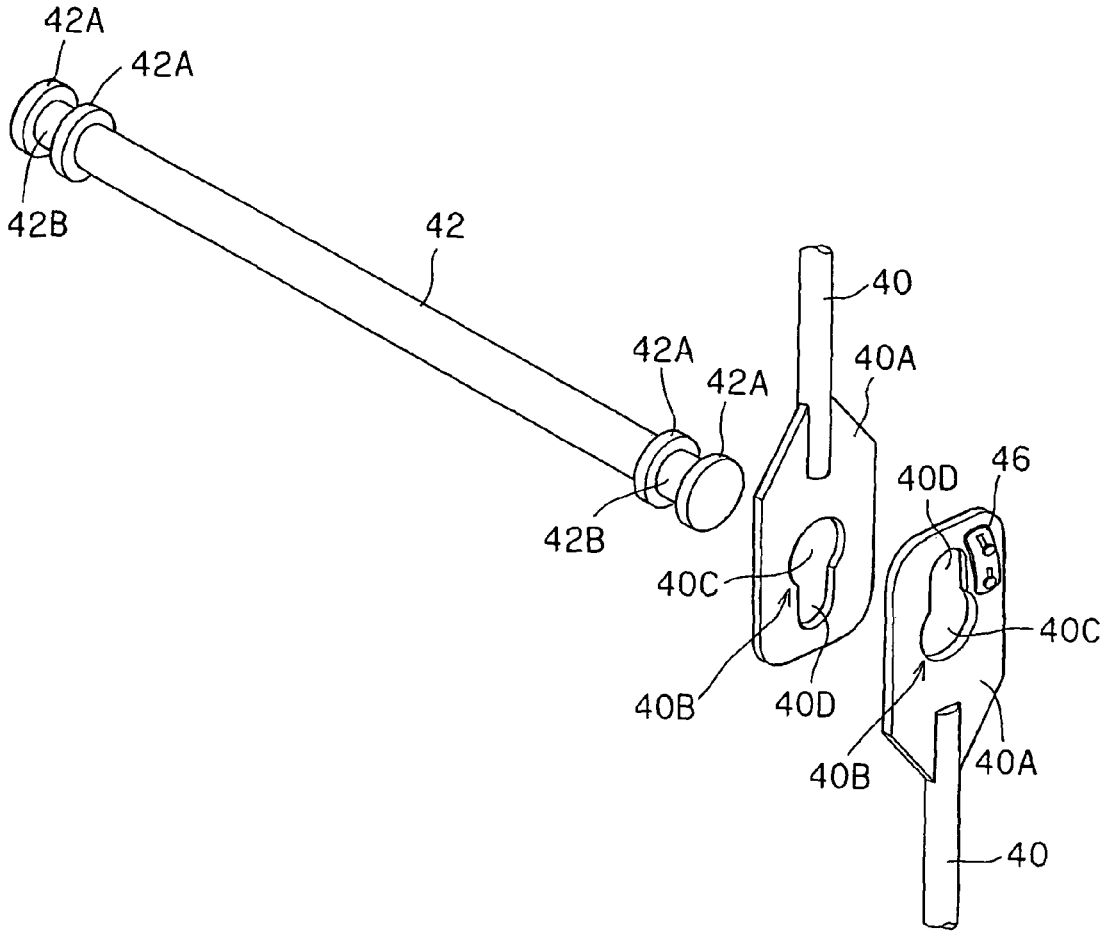
FIG. 5 is an exploded perspective view showing an assembling structure of a horizontal rod and perpendicular rods for the scaffold.
Figure 6:
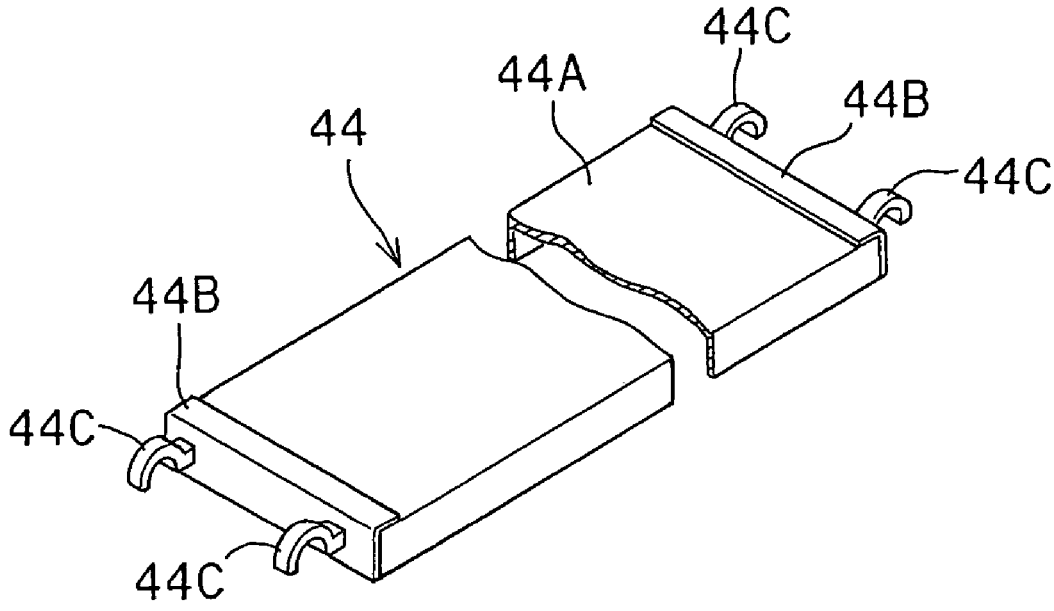
FIG. 6 is a perspective view of a scaffold board.

At first, as a basic constitution of the inspection scaffold, there are the scaffold lifting/supporting beams 32 suspended on the wires 36 (refer to FIG. 2 to FIG. 3). As shown in FIG. 4 to FIG. 6, plural pairs of perpendicular rods 40 are suspended under the scaffold lifting/supporting beams 32, and a second layer scaffold is formed with horizontal rods 42 fit into the respective pairs of the perpendicular rods 40, and scaffold boards 44 bridged between the respective horizontal rods 42. Further, a pair of perpendicular rods 40 are respectively suspended from the horizontal rods 42 of the second layer, the horizontal rods 42 are fit into the respective pairs of the perpendicular rods 40, and the scaffold boards 44 are bridged between the respective horizontal rods 42 to thereby form a third layer scaffold. The scaffolds of a fourth layer, a fifth layer, and so on are formed as same as the above to come to a required number of steps, and a whole temporary scaffold is constituted by these plural layers of scaffolds.

FIG. 5 is an exploded perspective view showing details of the perpendicular rods 40 and the horizontal rod 42 forming the scaffold of lower layers under the scaffold lifting/supporting beam 32. Two pieces of flanges 42A, 42A are respectively welded at both ends of the horizontal rod 42. Besides, coupling boards 40A are welded at both ends of the perpendicular rod 40, and a potbelly shaped hole 40B is formed on the coupling board 40A, which is formed by connecting a large-diameter hole 40C having a slightly larger diameter than the diameter of the flange 42A of the horizontal rod 42 and a small-diameter hole 40D having a slightly larger diameter than the diameter of a bar portion 42B of the horizontal rod 42.

A shape of the potbelly shaped hole 40B is described in more detail, a semicircular portion of the small-diameter hole 40D and the large-diameter hole 40C are connected by a parallel groove having an equal width with the diameter of the small-diameter hole 40D, and the bar portion 42B of the horizontal rod 42 is movable between the large-diameter hole 40C and the small-diameter hole 40D.

Besides, the spaces between the two pieces of flanges 42A, 42A respectively attached at both ends of the horizontal rod 42 are slightly larger than a double of a thickness of the coupling board 40A attached at the both ends of the perpendicular rod 40.

The flange 42A of the horizontal rod 42 is inserted from the large-diameter holes 40C of the coupling board 40A at a lower end of the perpendicular rod 40 suspended from an upper layer and the coupling board 40A at an upper end of the perpendicular rod 40 to be suspended to a lower layer respectively, and they are engaged to the respective small-diameter holes 40D with the bar portion 42B at the space between the two pieces of flanges 42A, 42A. A gripper 46 for gripping the bar portion 42B of the horizontal rod 42 engaged with the respective small-diameter holes 40D is provided at the coupling board 40A of the upper end of the perpendicular rod 40.

FIG. 6 is a perspective view showing the scaffold board 44. The scaffold board 44 is constituted by a scaffold board main body 44A which is U-shaped in cross section, and hook bases 44B, 44B attached at both end portions in a longitudinal direction of the scaffold board main body 44A to which two hooks 44C, 44C are provided respectively.

Between the horizontal rod 42 and the adjacent horizontal rod 42 bridged to the paired perpendicular rods 40 of each layer, the scaffold board 44 is bridged by engaging the hooks 44C, 44C provided at the both ends in the longitudinal direction thereof with the horizontal rods 42, to be the scaffold of each layer.

In the scaffold having such a basic constitution, in the present embodiment, plural lines of coil groups are regarded as one block, which are formed by arranging narrow tubes 50 in similar shapes in a plane state at respective headers 48 positioning at an upper end of the superheater 14, and scaffold units are assembled by each block. Namely, as shown in FIG. 1 to FIG. 3, the superheater 14 has a structure in which a number of narrow tubes 50 are connecting from an entrance header 48A positioning at an upper end to an exit header 48B. The plural narrow tubes 50 curved in the similar shape in approximately U-shape are arranged in a same plane surface state to form a coil group, and two surfaces of these coil groups in plane arrangement are suspended in parallel state from one header 48 (entrance header 48A and exit header 48B) (refer to FIG. 2). In the embodiment, six surfaces of the coil groups suspended from three headers 48 are grouped as one block, and the scaffold is assembled by this block unit. Consequently, as it is understood from FIG. 3, the scaffold lifting/supporting beams 32 are constituted by framing beams in parallel with a plane surface of the coil group and the beams in orthogonal with the coil surface when viewed from the plane surface in rectangle or in ladder state. Herewith, the scaffold lifting/supporting beams 32 can be raised/lowered between the spaces of the coil group tubes of the superheater 14 without interference with the coils. This framed scaffold lifting/supporting beam 32 and scaffold composing members assembled to this constitute a scaffold unit 51.

By the way, the ceiling tube wall 34 is provided at an upper position of the superheater 14 to horizontally cross the coil groups, in which a number of ceiling tubes are thickly arranged in plane state, and the ceiling tubes are coupled with each other by membrane bars. Consequently, the ceiling tube wall 34 becomes a horizontal member of the superheater 14, so the above-stated scaffold is assembled to this ceiling tube wall 34 as a mounting base end.

Figure 7:
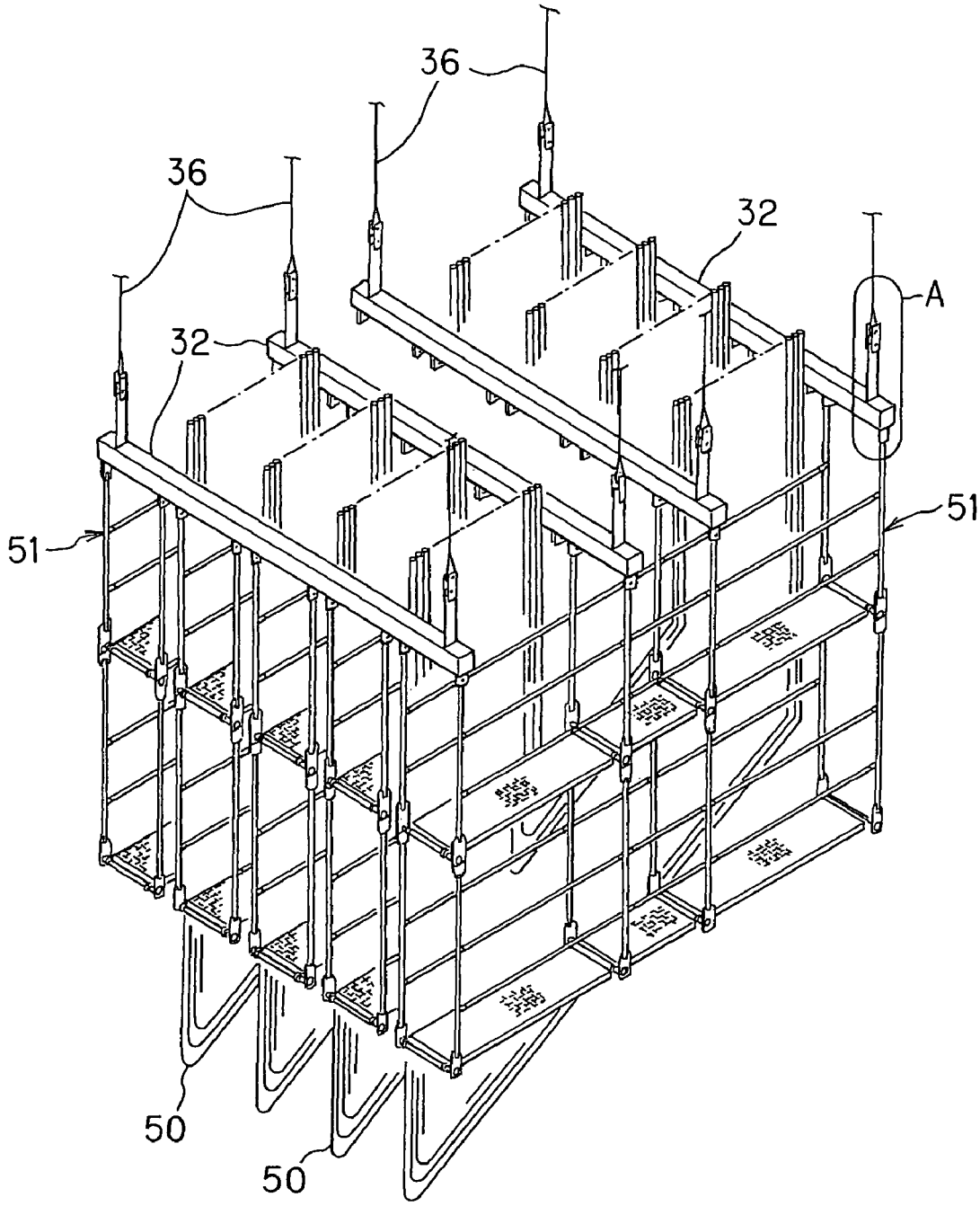
FIG. 7 is a perspective view showing a state a scaffold unit is assembled and lifted to a superheater.
Figure 8:
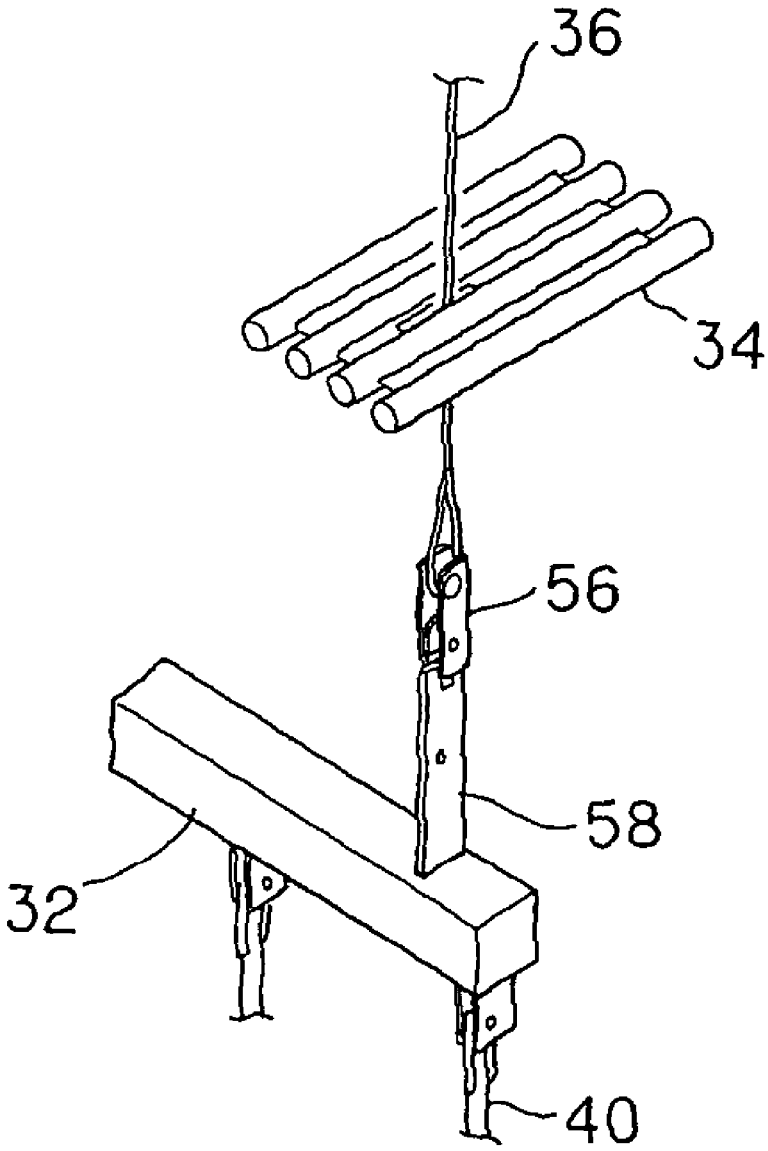
FIG. 8 is a detail of "A" portion in FIG. 7.

A concrete attaching procedure of the scaffold is described in detail with reference to FIG. 7 to FIG. 10. In this embodiment, the scaffold lifting/supporting beams 32 interposed in spaces formed between each coil group of the third superheater 14 being the large component, framed in rectangle or in ladder state, are suspended on the wires 36 lifted down from the spaces of the ceiling tube wall 34 as the above-stated horizontal member. As shown in FIG. 8, the spaces of the ceiling tube wall 34 may be opened on the membrane bar 52 connecting the ceiling tubes with each other. As shown in FIG. 1, the wire 36 suspended by using a wire attaching fixture 54 attached to a crane hook is penetrated into the space of the ceiling tube wall 34 and then reeled out. Of course, a hoisting machine and so on mounted on the component supporting beam 30 can be used. A suspended clasp 56 is provided at a lower end of the wire 36 so as to be coupled to a strip-plate 58 provided at an upper surface portion of the scaffold lifting/supporting beam 32. The sizes of the strip-plate 58 and the suspended clasp 56 are set so that they can penetrate into the opening space of the membrane bar 52.

As stated above, the scaffold lifting/supporting beam 32 suspended on the wire is once lifted down near to the floor surface of the moving jack stand 28, the perpendicular rods 40, the horizontal rods 42 as the scaffold composing members are assembled to this, and the scaffold board 44 is bridged between the pair of the horizontal rods 42 to perform the assembling of the scaffold at the first stage. Herewith, the scaffolds are built in the spaces of the coil group within the superheater 14. The scaffold lifting/supporting beam 32 is lifted to raise little by little, and the scaffold components are assembled sequentially toward downward to assemble the required number of steps of the scaffolds, as shown in FIG. 7. In an example shown in FIG. 7, two scaffold units 51 are lifted up at the same time, and they are lifted up in a state fixing between the scaffold units 51 by a coupling scaffold board 60 so as not to move mutually. Herewith, the plural scaffold units 51 can be assembled simultaneously.

Figure 9:
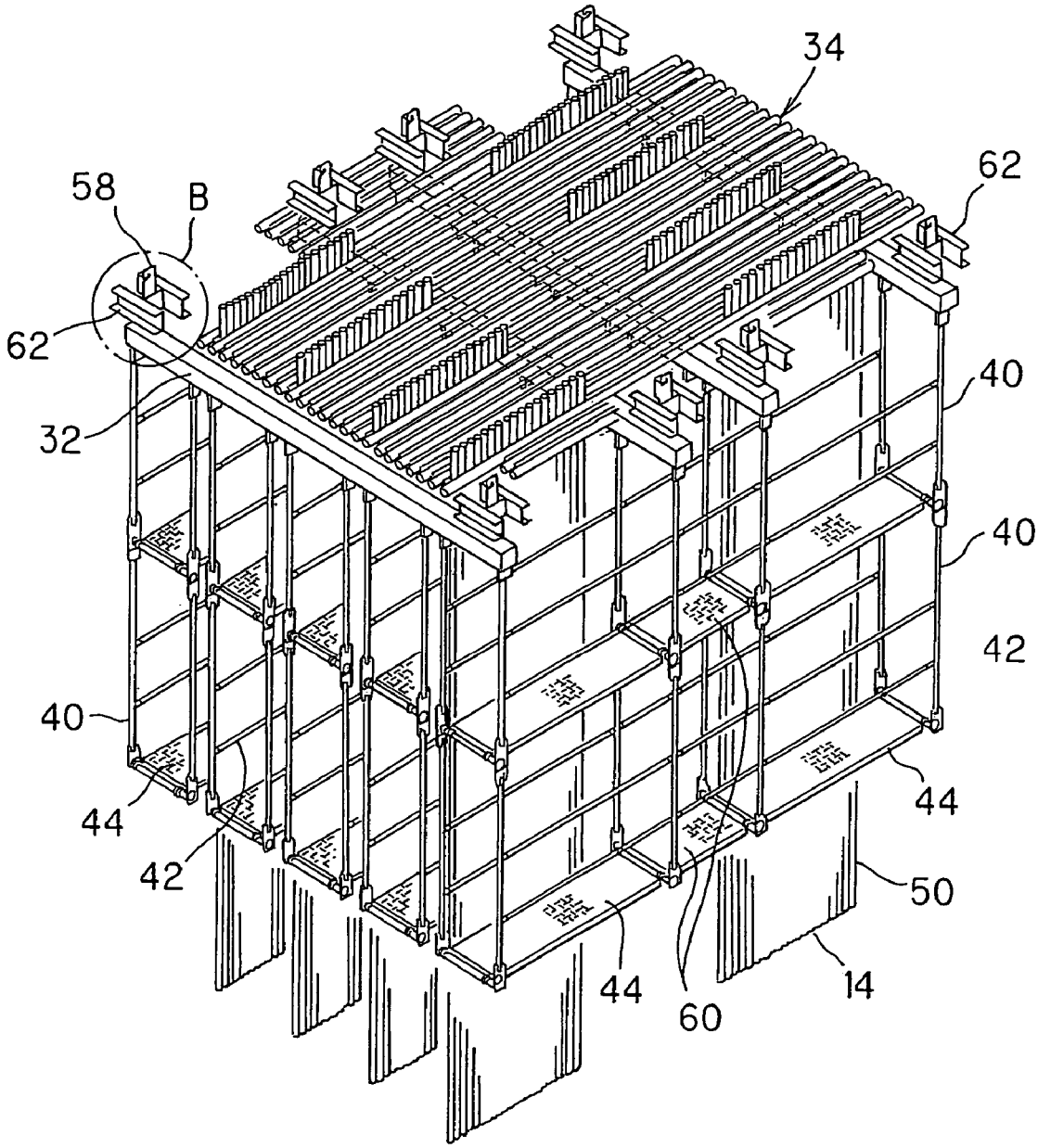
FIG. 9 is a perspective view showing a state the scaffold unit is fixed to the superheater.
Figure 10:
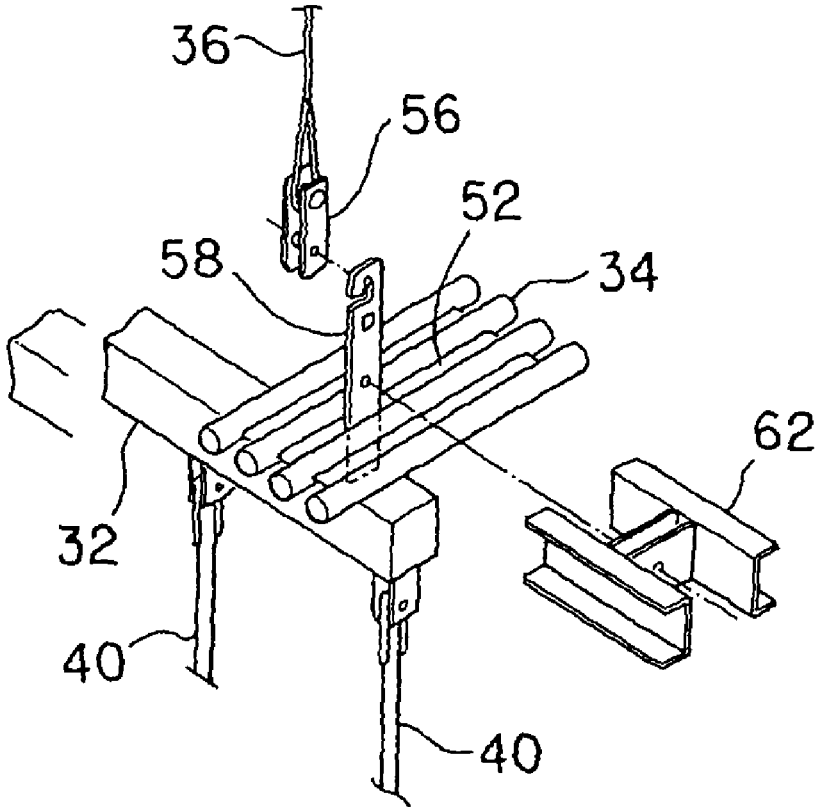
FIG. 10 is a detail of "B" portion in FIG. 9.

As shown in FIG. 9, when the scaffold lifting/supporting beam 32 reaches the ceiling tube wall 34 of the superheater 14, the strip-plate 58 is penetrated into the space of the ceiling tube wall 34, and as shown in FIG. 10, a receiving beam 62 is coupled to be supported to the strip-plate 58 at an upper surface side of the ceiling tube wall 34. The receiving beam 62 is to transmit a load of the scaffold unit 51 to the ceiling tube wall 34, and U-shaped steels are combined to be a plane H-shape and welded to be coupled. The number of the ceiling tubes by which a weighted load of the scaffold unit 51 can be supported is asked by calculation in advance to determine a length of the receiving beam 62. As stated above, the scaffold units 51 are assembled to the superheater 14 one after another to thereby build the scaffold on the ground with which a worker is movable to every place facing to the coil of the superheater 14.

As stated above, the scaffold is assembled integrally with the superheater 14 and fixedly supported. As shown in FIG. 11, suspending rods are suspended from lifting jacks 22 as lifting means provided on the main-beam 16, and coupled to the component supporting beam 30 to raise this superheater 14 integrated with the scaffold. At this time, the work of the attachment of the attendant equipments for the superheater 14 may be performed simultaneously. After the attachment of the attendant equipments are completed, the lifting jacks 22 are continuously operated so as to raise the superheater 14 with the scaffold to an upper end of the steel frame, then they are coupled to the main-beam 16, and thereby, the inspection scaffold 20 are built simultaneously with the installation of the superheater 14 as the large component.

As stated above, in the present embodiment, at a stage before the superheater is attached to the main-beam 16, in particular, when it is carried in the steel frame of the power station, the scaffold lifting/supporting beams 32 capable of raising/lowering in the spaces of the coil groups of the corresponding superheater 14 are disposed as the ground work, and in a state that they are suspended on the wires 36 penetrating the ceiling tube wall 34 of the superheater 14, the scaffold composing members can be sequentially assembled to a lower surface of the supporting beams 32 by the ground work. When the scaffold assembling of required number of steps is completed, the scaffold lifting/supporting beams 32 are coupled to the ceiling tube wall 34 by using the strip-plates 58 and the receiving beams 62 as coupling means. Herewith, the scaffold is supported by the superheater 14 in itself. The plural scaffold units 51 are coupled mutually by the coupling scaffold boards 60, and then the entire inspection scaffold 20 is integrally blocked with the superheater 14 to thereby install the superheater 14 together with the scaffold to the main-beam 16.

Incidentally, in the above-stated embodiment, an example applied to the third superheater 14 is described, but the present invention can be applied to the second superheater 12 and to the equipments having the other pendant coils.

From these reasons, in the present embodiment, it is possible that the scaffold assembling for the pendant coil as the large component for the boiler requiring inspections is not performed at the high-place work, but assembled safely. Besides, the scaffold assembling is performed at the ground work, so the inspection scaffold is simultaneously built when the pendant coil is installed to the main-beam, and therefore, the hours of work for the scaffold assembling can be reduced drastically. Further, the scaffold in itself is placed so as to embed the spaces of the pendant coils, and therefore, it is possible to assemble the power station while a protective function for the attendant structures of the pendant coil is added to the scaffold.

What is claimed is:

1. A building method of assembling an inspection scaffold and a large component for a boiler, the inspection scaffold having a plurality of scaffold supporting beams and a plurality of scaffold components, comprising:

simultaneously assembling the inspection scaffold with the large component at a ground surface, simultaneously assembling at the ground surface comprising:

(a) assembling the plurality of scaffold supporting beams to a plurality of wires suspended from a wire attaching fixture, the plurality of scaffold supporting beams being assembled between spaces of the large component while the large component is suspended from a large component supporting beam at the ground surface;

(b) assembling the plurality of scaffold components sequentially to a lower surface of the plurality of scaffold supporting beams;

(c) coupling the plurality of scaffold supporting beams to a horizontal member of the large component, after a required number of steps of the plurality of scaffold components are assembled;

(d) raising the large component with the inspection scaffold by a lifting means to a main support member; and (e) coupling the large component with the inspection scaffold to the main support member.

2. The building method according to claim 1, wherein the inspection scaffold is assembled by raising each scaffold unit composed of the plurality of scaffold supporting beams, a plurality of rods coupled to a lower surface side of the plurality of scaffold supporting beams, and a plurality of scaffold boards coupled to the plurality of rods, the inspection scaffold being coupling to the horizontal member of the large component, and thereafter, coupling each of the scaffold units with each other to be integrated.

3. The building method according to claim 2, wherein the large component is a pendant coil having a plurality of lines of coil groups, formed by arranging narrow tubes in similar shapes on respective headers in one plane state, each pendant coil is regarded as one block, and each of the scaffold units are assembled by each block.

4. The building method according to claim 1, wherein the large component is a superheater, and the horizontal member is a ceiling tube wall.

* * * * *